US008104633B2

(12) United States Patent
Ramsey et al.

(10) Patent No.: US 8,104,633 B2
(45) Date of Patent: Jan. 31, 2012

(54) CONTAINER CLOSURE ASSEMBLY

(75) Inventors: Christopher Paul Ramsey, Wantage (GB); Katie Bodnar, Abingdon (GB)

(73) Assignee: Obrist Closures Switzerland GmbH, Reinach (CH)

( * ) Notice: Subject to any disclaimer, the term of this patent is extended or adjusted under 35 U.S.C. 154(b) by 473 days.

(21) Appl. No.: 11/996,853

(22) PCT Filed: Jul. 27, 2006

(86) PCT No.: PCT/EP2006/064724

§ 371 (c)(1),
(2), (4) Date: Apr. 3, 2008

(87) PCT Pub. No.: WO2007/020169

PCT Pub. Date: Feb. 22, 2007

(65) Prior Publication Data

US 2008/0223740 A1 Sep. 18, 2008

(30) Foreign Application Priority Data

Aug. 12, 2005 (EP) ..... 05255021

(51) Int. Cl.
*B65D 1/24* (2006.01)
*B65D 45/06* (2006.01)
*B65B 7/28* (2006.01)

(52) U.S. Cl. ..... 220/521; 220/801; 215/44

(58) Field of Classification Search ..... 215/44, 215/43, 258, 254, 253, 251, 252, 250, 329, 215/316, 352, 341, 364, 228, 217, 223, 214, 215/211, 215, 297, 296, 295, DIG. 8; 220/522, 521, 266, 267, 277, 265, 260, 212, 802, 801, 796, 293, 288, 200; 206/222, 221, 223, 217, 216, 219; 222/81, 143, 129, 563; D9/437, 436, 438, 440, 439, 449, 447, 435, 434; *B65D 1/24, 1/36; B65B 7/28*

See application file for complete search history.

(56) References Cited

U.S. PATENT DOCUMENTS 3,156,369 A * 11/1964 Bowes et al. ..... 206/222
3,326,400 A * 6/1967 Hamelin et al. ..... 206/221
3,441,179 A * 4/1969 Ragan ..... 222/129

(Continued)

FOREIGN PATENT DOCUMENTS

DE 29820062 2/1999

(Continued)

*Primary Examiner* — Mickey Yu
*Assistant Examiner* — Robert J Hicks
(74) *Attorney, Agent, or Firm* — Shoemaker and Mattare

(57) ABSTRACT

A closure assembly has a closure cap adapted to be fitted to the neck of a container to close the container. The cap has an upper wall and a cylindrical skirt depending from the upper wall. A reservoir is formed on the underside of the upper wall radially within the skirt and has a dispensing opening. A sealing member is fitted into the closure cap to close the dispensing opening in the reservoir. When the assembly is fitted to the container the sealing member fits into the neck of the container with an interference fit such that when the closure cap is removed from the container, the sealing member remains held within the neck of the container and is separated from the closure cap so that the dispensing opening is opened and material contained therein is dispensed into the container.

5 Claims, 4 Drawing Sheets

U.S. PATENT DOCUMENTS

| | | | | | |
|---|---|---|---|---|---|
| 3,454,177 | A | * | 7/1969 | Bloom | 206/222 |
| 3,655,096 | A | * | 4/1972 | Easter | 222/82 |
| 3,840,136 | A | * | 10/1974 | Lanfranconi et al. | 215/6 |
| 3,924,741 | A | * | 12/1975 | Kachur et al. | 206/221 |
| 4,024,952 | A | * | 5/1977 | Leitz | 206/221 |
| 4,132,308 | A | * | 1/1979 | Goncalves | 206/219 |
| 4,203,517 | A | * | 5/1980 | Hildebrandt et al. | 206/221 |
| 5,465,835 | A | * | 11/1995 | Schumacher et al. | 206/221 |
| 6,047,818 | A | * | 4/2000 | Warby et al. | 206/221 |
| 6,279,779 | B1 | | 8/2001 | Laciacera et al. | |
| 2004/0036229 | A1 | * | 2/2004 | Takahashi et al. | 277/628 |
| 2004/0200740 | A1 | | 10/2004 | Cho | |
| 2004/0200741 | A1 | | 10/2004 | Cho | |

FOREIGN PATENT DOCUMENTS

| | | |
|---|---|---|
| EP | 1477421 | 11/2004 |
| JP | 2005088997 | 4/2005 |

* cited by examiner

CONTAINER CLOSURE ASSEMBLY

The invention relates to container closure assemblies and in particular to container closure assemblies incorporating a reservoir for material (typically a liquid) which is kept separate from the material (again typically liquid) in the container until mixing of the materials is required.

Such arrangements are known, for example, in relation to certain drinks where the drink is best consumed only shortly after the mixing has taken place. In one known arrangement a generally cylindrical reservoir for liquid is screw threaded into an annular end piece fitted irremovably to the neck of a container. When the reservoir is removed from the end piece, a closure member is dislodged from the reservoir and drops into the container allowing liquid in the reservoir to be dispensed through the end piece into the container. When the reservoir has been completely removed from the end piece the mixed liquids can be poured through the end piece.

The arrangement described above is not suitable for use with standard container filling apparatus using, for example, standard (PCO neck finish) PET bottles and standard profile closure caps which are screwed onto the bottles and removed therefrom by unscrewing and breaking a tamper evident ring. In the prior arrangement the bottle form must be different since the end piece must not be removable and the profile of the end piece with reservoir fitted is entirely different from that of a standard closure cap.

It is the aim of the present invention to provide a solution in which no modification to the industry standard bottle is required and in which the profile of the closure is such that it can be handled on unmodified filling lines.

Accordingly, the invention provides a closure assembly for a container comprising: a closure cap adapted to be fitted to the neck of a container to close the container comprising an upper wall and a cylindrical skirt depending therefrom and having a reservoir formed on the underside of the upper wall within the skirt and provided with a dispensing opening; and a sealing member adapted to be fitted into the closure cap to close the dispensing opening in the reservoir; wherein the sealing member is adapted to fit into the neck of the container, when the assembly is fitted thereto, with an interference fit such that when the closure cap is removed from the container, the sealing member remains held within the neck of the container and is separated from the closure cap so that the dispensing opening is opened and material contained therein is dispensed into the container.

The arrangement allows for the reservoir to be filled and the sealing member to be fitted to the closure cap to form an assembly which can be freely transported and handled by standard machinery set up to handle a plain container closure consisting simply of an end wall and a depending skirt.

Embodiments of the invention are described below with reference to the accompanying drawings in which.

Figure 2:
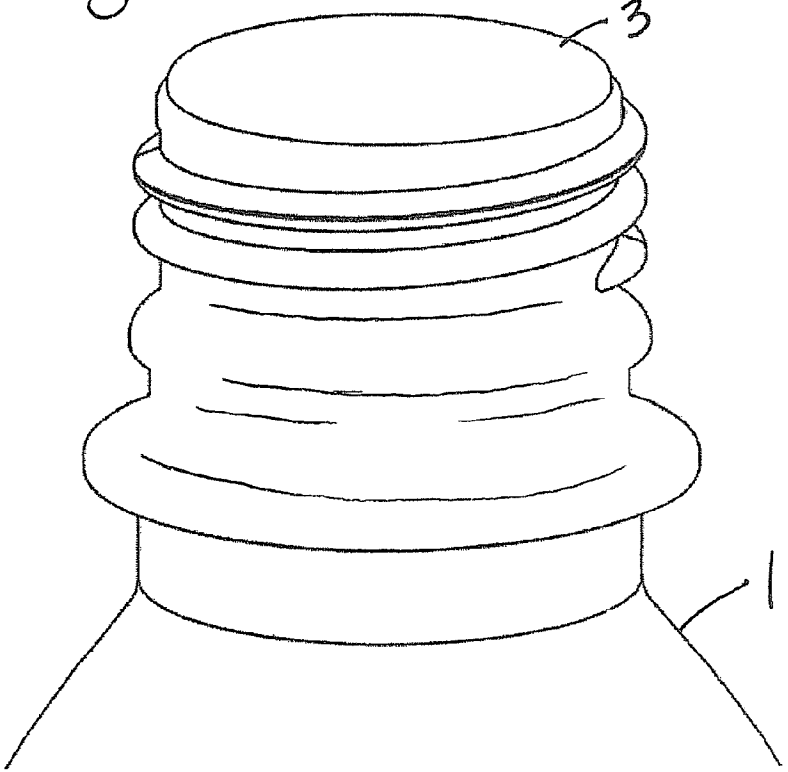
FIG. 2 is a perspective view of the top of the container with the closure cap removed.
Figure 1:
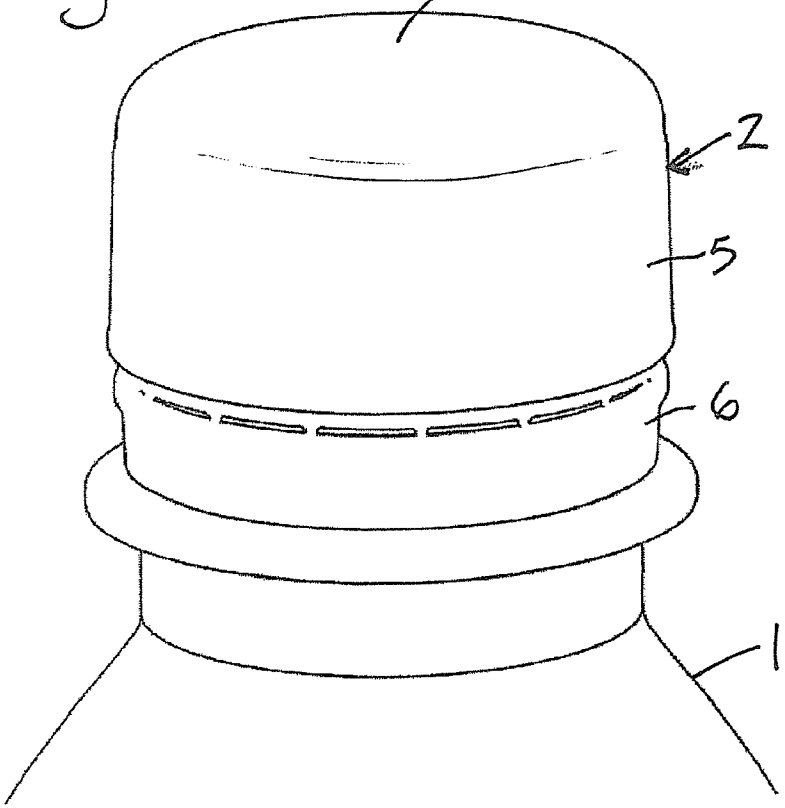
FIG. 1 is a perspective view of the top of a container fitted with a closure assembly according to the invention.
Figure 4:
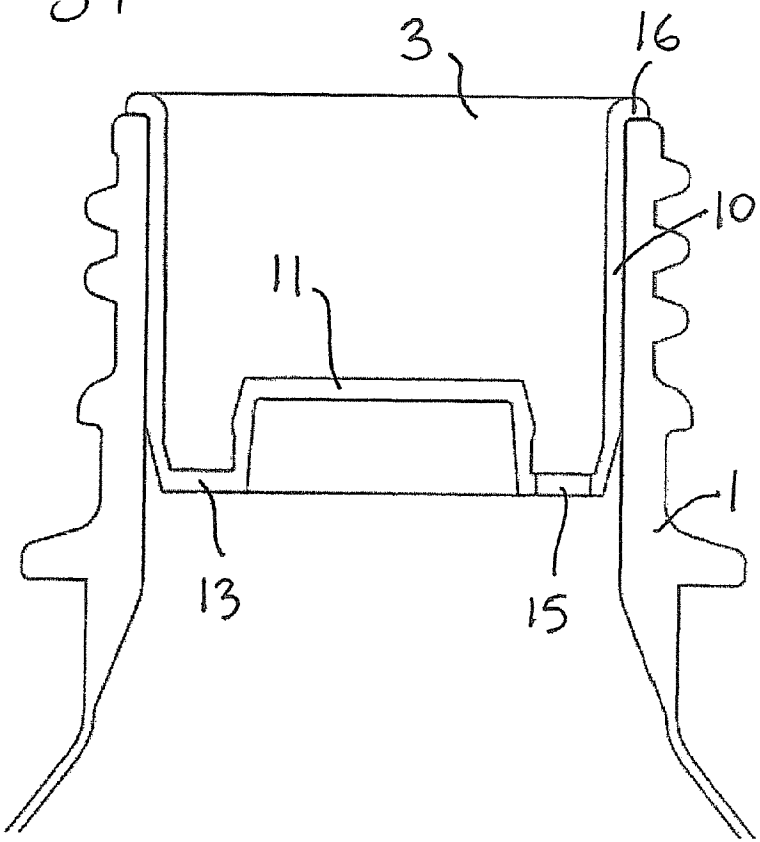
FIG. 4 is a vertical section through the top of a container with the closure cap removed but with the sealing member located in the neck of the container.

The closure assembly shown in the drawings is for use with a container 1 having an external screw thread on its neck. The container is a bottle and typically will be made of PET plastics, metal or glass. The closure assembly comprises a cap 2 and a sealing member 3. The cap 2 has an upper wall 4 with a cylindrical skirt 5 depending therefrom. The skirt has an internal screw thread on the inside of the skirt for fitting to the container. As shown in FIG. 1, the cap is formed with a tamper indicating ring 6 which is broken away from the skirt when the closure is first opened. As also seen from FIG. 1, the outer profile of the cap is entirely conventional.

A reservoir 7 is formed within the skirt 5 on the underside of the upper wall 4 of the cap. The reservoir is formed by a cylindrical wall 8 extending downwardly from the underside of the upper wall 4 and a dispensing opening 9 is defined by the free end of the wall 8.

The sealing member 3 is sized to be fitted into the closure to close the dispensing opening 9. The sealing member 3 comprises a cylindrical bore 10 and a plug 11 supporting coaxially within the bore 10 at its lower end by a plurality of bridges 13, preferably four.

Figure 6:
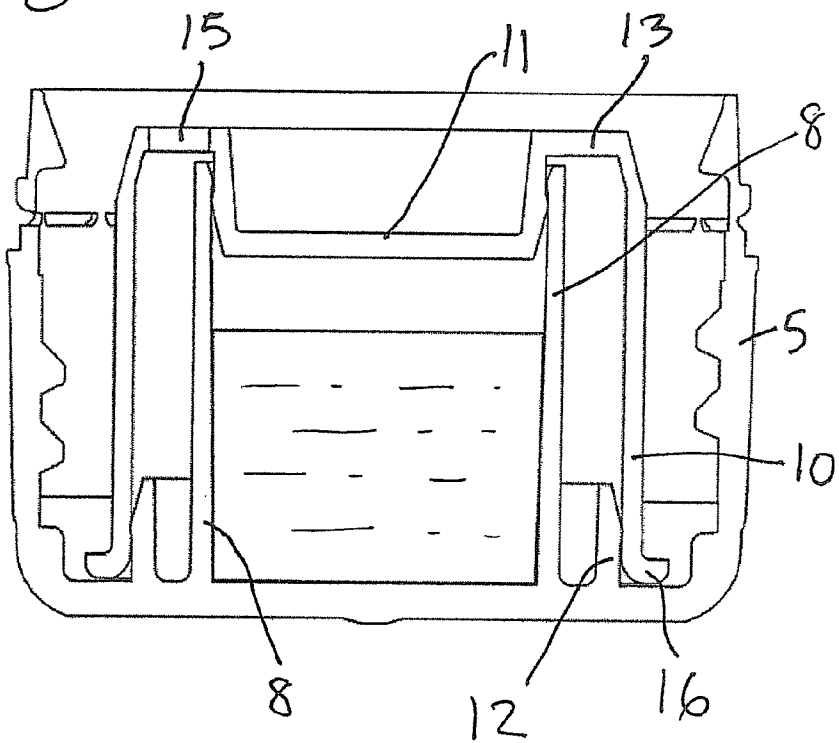
FIG. 6 is a section through the closure assembly after filling and fitting of the sealing member into the closure cap.
Figure 5:
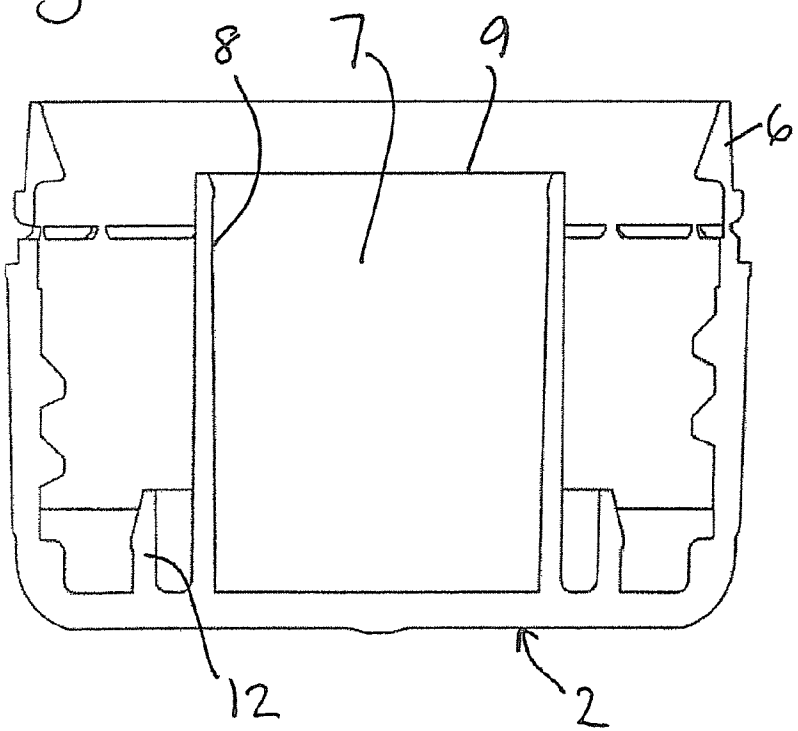
FIG. 5 is a section through the closure cap inverted for filling.
Figure 8:
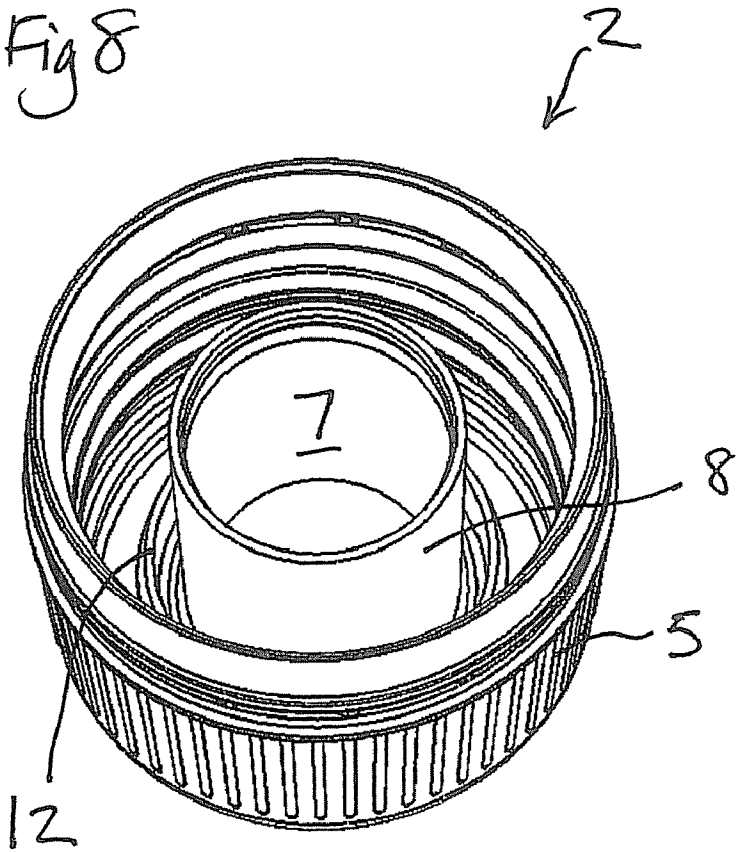
FIG. 8 is a perspective view from above of the inverted closure cap.
Figure 7:
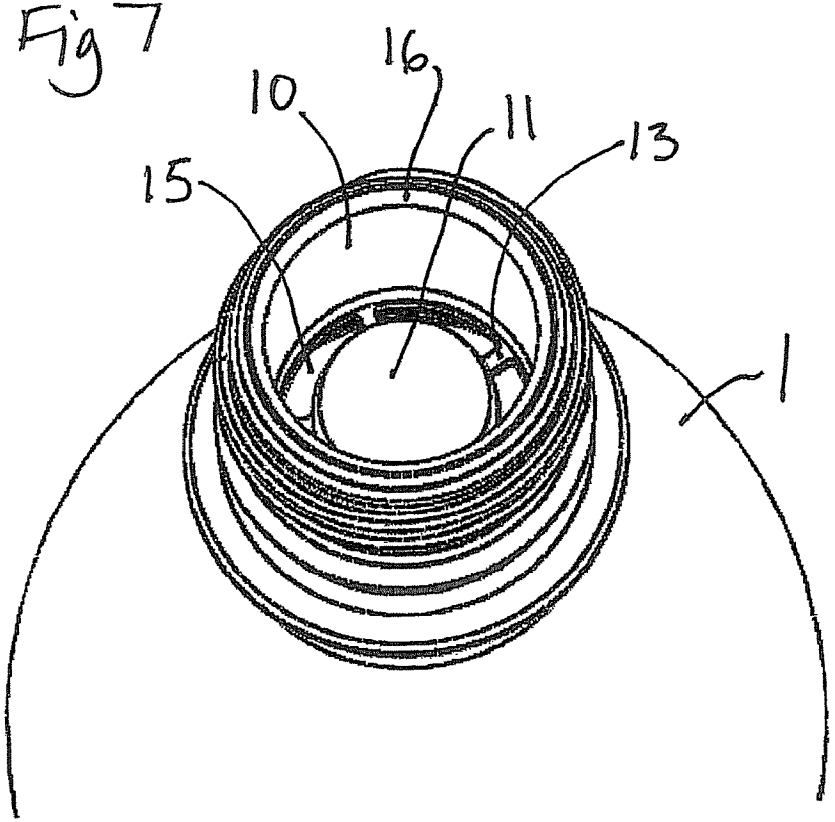
FIG. 7 is a perspective view from above of the neck of a container with the sealing member located therein.

Referring to FIGS. 5 and 6, the cap is shown inverted before and after filling of the reservoir with a small amount of liquid and fitting of the sealing member into the cap. The plug 11 fits into the open end of the cylindrical wall 8 to form a bore seal therewith to close the dispensing opening 9. The plug may be a snap fit in the wall 8 to help retain the assembly of cap 2 and sealing member 3 in fitted relationship during transport, storage and handling of the assembly. A second cylindrical wall 12 extends downwardly from the underside of the closure cap radially outwardly of the reservoir and fits sealingly into the upper end of the cylindrical bore 10 of the sealing member.

Figure 3:
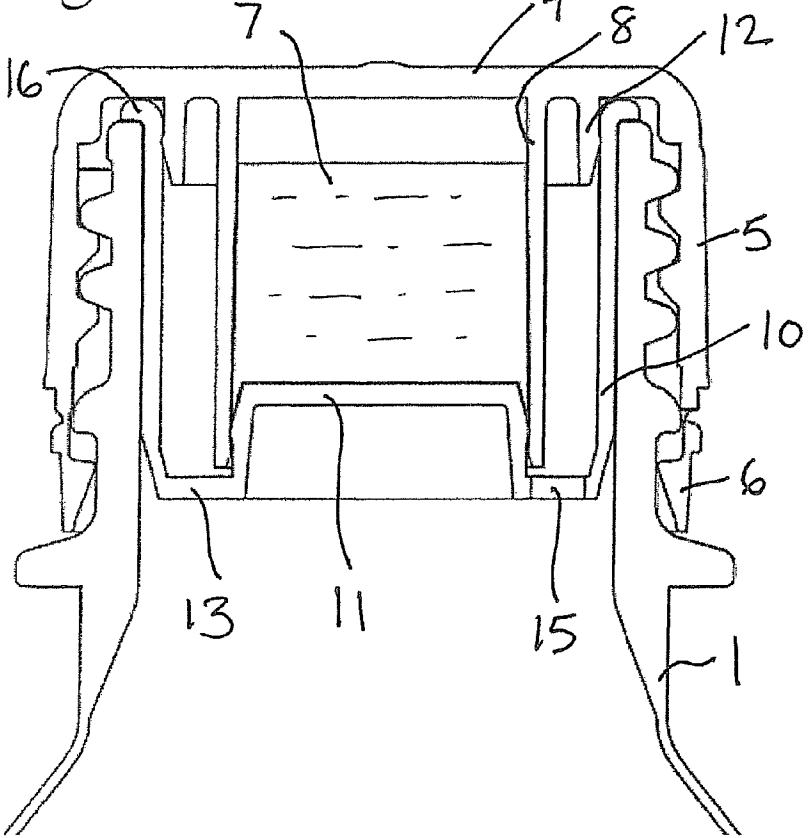
FIG. 3 is a vertical section through the top of a container and closure cap assembly.

When the assembly is fitted to the container 1 as shown in FIG. 3, the bore 10 of the sealing member fits into the neck of the container with an interference fit such that when the closure cap 2 is unscrewed from the container, the sealing member 3 remains held within the neck of the container and is separated from the closure cap. As the cap 2 and sealing member 2 are separated, the plug 11 comes out of the wall 8 of the reservoir so that the dispensing opening 9 is opened. Liquid held in the reservoir can then pass out of the reservoir to be dispensed into the container through a passages 15 in the sealing member formed between the bridges 13. The mixed contents of the container can then be poured out through the passages 15. As best shown in FIG. 3, the upper end of the sealing member is formed with an out-turned radial flange 16 which forms a seal between the upper end of the container neck and the underside of the cap 2.

The sealing member is made of a softer material then the closure cap. In a preferred embodiment the sealing member is made from polyethylene and the closure cap is made from polypropylene.

In an assembly for use on a standard 28 mm diameter bottle neck, the reservoir may have a diameter of about 12 mm and will be filled to a depth of about 9 mm giving a liquid volume of about 1 ml. In an assembly for use on a 38 mm diameter bottle neck, the reservoir may have a diameter of about 22 mm and be filled to a depth of about 13 mm giving a liquid volume of about 5 ml. Such reservoirs will not extend below the skirt 5 or may extend only very slightly. If required, the reservoir could be made much deeper for certain applications but this will hinder high speed handling.

The invention claimed is:

1. A closure assembly for a container having a threaded neck, said assembly comprising:

a closure cap adapted to be removably fitted to the neck of the container to close the container, said closure cap comprising an upper wall and a cylindrical skirt having an internal screw thread depending from said upper wall, a reservoir being formed on the underside of the upper wall within the skirt and provided with a dispensing opening; and a sealing member adapted to be fitted into the closure cap to close the dispensing opening in the reservoir; wherein the sealing member is adapted to fit into the neck of the container, when the assembly is fitted thereto, with an interference fit between the neck and the sealing member such that when the closure cap is removed from the container, the sealing member remains held within the neck of the container and is separated from the closure cap so that the dispensing opening is opened and material contained therein is dispensed into the container, the reservoir is formed by a cylindrical wall extending downwardly from the underside of the upper wall of the closure cap, the sealing member comprises a cylindrical bore sized to fit sealingly into the neck of the container and wherein a plug is supported coaxially within the cylindrical bore at its lower end by a plurality of radial bridges, the plug is adapted to fit into the open end of the cylindrical wall of the reservoir to close the reservoir when the closure cap and sealing member are fitted together and passages are formed between the radial bridges such that when the closure cap is separated from the sealing member, material can be dispensed from the reservoir through the passages and into the container.

2. An assembly according to claim 1, wherein a second cylindrical wall extends downwardly from the underside of the closure cap radially outwardly of the reservoir to fit sealingly into the sealing member.

3. An assembly according to claim 1, wherein the sealing member is made from a softer material than the closure cap.

4. An assembly according to claim 1, wherein the sealing member is made from polyethylene and the closure cap is made from polypropylene.

5. An assembly according to claim 1, in combination with a container having a neck with an external screw thread.

* * * * *